United States Patent [19]

Maher

[11] Patent Number: 5,048,620

[45] Date of Patent: Sep. 17, 1991

[54] METHOD FOR AIR ROTARY DRILLING OF TEST WELLS

[76] Inventor: Kevin P. Maher, 53 Londonderry Rd., Windham, N.H. 03087

[21] Appl. No.: 390,619

[22] Filed: Aug. 7, 1989

[51] Int. Cl.[5] ..... E21B 21/00; E21C 7/00

[52] U.S. Cl. ..... 175/71; 175/69; 175/72

[58] Field of Search ..... 166/77.5, 78, 82, 195, 166/308; 175/65, 67, 69, 71, 72, 195, 205, 207, 209, 212, 218, 220

[56] References Cited

U.S. PATENT DOCUMENTS

| | | | |
|---|---|---|---|
| 2,786,652 | 3/1957 | Wells | 175/71 |
| 3,495,664 | 2/1970 | Kelly | 175/69 |
| 4,315,553 | 2/1982 | Stallings | 175/207 |

OTHER PUBLICATIONS

Oil and Gas Journal-Sep. 6, 1954, Hassebroek et al.-pp. 109-112.

*Primary Examiner*—Bruce M. Kisliuk

*Attorney, Agent, or Firm*—McGlew & Tuttle

[57] ABSTRACT

An apparatus for air rotary drilling in saturated unconsolidated deposits. It consists of a drill rod connected to a drill bit and a drill casing surrounding the drill rod which defines a well in a drilled region. A pressurized air source is connected to the drill rod, the drill rod having a bore for supplying air under pressure to the drill bit, to force air and material up the drill casing in an area defined between the drill rod and the drill casing. A rotary drive arrangement drives the drill rod in rotation to provide a drilling action in cooperation with the high pressure air, the high pressure air source providing high pressure air to the drill rod bore. A snorkel discharge arrangement discharges air and material from the space defined between the drill pipe and the drill rod. A pressure control arrangement is provided for sealing the space between the drill pipe and the drill rod upon termination of forced high pressure air into the drill rod bore and successively lowers the pressure in the space between the drill rod and the drill pipe at a predetermined rate to avoid heave.

2 Claims, 2 Drawing Sheets

METHOD FOR AIR ROTARY DRILLING OF TEST WELLS

FIELD OF THE INVENTION

This invention relates, in general, to well drilling and, in particular, to a new and useful method and apparatus for air rotary drilling, of wells. The invention provides an efficient technique for great depth rotary drilling in saturated unconsolidated deposits.

BACKGROUND OF THE INVENTION

At the present time, air rotary drilling can be conducted in loose unconsolidated sediments when a dual rotary drilling system, such as a Barber DR 26/12 drill is utilized. However, the method is severely hindered by uncontrollable formation heaves that occur when the air circulation ceases.

According to known practices, lengths of drill rod and casing are added and connected to the well bore by threads for the rods and a welded joint for the drill casing. Each of the drill rod and casing are positioned so that they are attached beneath a discharge snorkel. The rod and casing lengths are typically either 10 or 20 feet.

To begin drilling, compressed air is piped through the top drive to the interior of the drill rod. As the pressure builds, the air overcomes the hydrostatic pressure in the casing, escapes out of the drill bit, and causes any water or material in the annular space between the drill rod and the casing to move upward toward the surface. The air flow circuit is completed as the material reaches the discharge snorkel and hose where it is discharged to the ground.

As air circulation becomes established the sediments are loosened by both the drill bit and escaping air. In a manner, similar to an air lift pumping system, the sediments and formation water are carried to the surface by the air. The resulting excavation at the bottom of the drill pipe enables advancement of the pipe. This same pipe rotates during the drilling to minimize skin friction.

Upon reaching the depth to where it becomes necessary to add the next length of drill rod and casing, the introduction of compressed air is stopped. It is at this instant that the heaving begins to occur. Since the drill rod and annular space are occupied only by the remnants of the air, they are essentially at atmospheric pressure. Meanwhile, the formation is under hydrostatic pressure equivalent to the weight of the overlying water. Thus, a very large pressure differential exists at the bottom of the drill pipe. In response to this differential, water rushes up through the annular space, with a velocity which is high enough to keep sediments as coarse as medium sand in suspension. As the water level in the annular space reaches the same level as that in the formation, the water velocity in the annular space drops to 0 and all of the sand in suspension settles out to the bottom of the hole.

The displaced and settled sand phenomena referred to as heave can be a significant problem. The amount of heave that occurs is dependent upon the depth beneath the water table, and the grain size distribution of the formation encountered by the drill bit. Sand heaves on the order of 250–300 feet have been encountered. The sand heave smothers the drill bit and does not permit the reestablishment of air circulation.

As a result of heave, it is necessary to retract the drill rod to a point where the drill bit is above the sand heave. The interior of the drill rod is then flushed by water jetting to make sure it is clean and free the entire length to the drill bit.

The sand is then removed from the inside of the drill pipe by circulating water through the drill system, and flushing the sand up through the annular space to the surface. Since the well is full of water, no additional heave occurs at this point. The flushing process continues, until the drill bit is again situated at the bottom of the drill pipe. The pullback and flushing operation typically takes between 4–6 hours.

SUMMARY AND OBJECT OF THE INVENTION

According to the invention, a pressure regulating arrangement is utilized to seal the annular area between the drill rod and drill pipe or casing to permit the well to remain under pressure when the air flow is terminated. The pressure regulating arrangement provides that the initial pressure maintained in the well equals the hydrostatic pressure in the formation. This equality in pressure prevents water and sand from entering the bottom of the drill pipe. The pressure regulating means or regulating arrangement slowly reduces the pressure in the well allowing a column of water to slowly rise in an annular space between the casing and drill rod and preventing material from entering the drill rod. The inventive arrangement provides that the velocity of the rising water is not great enough to cause any sand to be lifted in suspension. Pressure is lowered as air is continuously vented until the well reaches ambient conditions. The next lengths of casing and rod can be added immediately thereafter and the drilling operation resumed.

In accordance with a further feature of the invention, a pressure indicator is located at the top of the casement so that the pressure indicator thereby may be used to control the blow-out protector in order to gradually relieve the pressure which can be effected without the backup of large quantities of debris which must be drilled out upon the next drilling stage.

An object of the invention is to provide an improved method for effecting the drilling of wells at various levels which includes drilling to a predetermined depth with a drill casing and drill rod arrangement so that the pressure is not relieved at the location of the drilling and subsequently permitting a gradual reduction of the pressure to avoid heave.

A further object of the invention is to provide a device for effecting the drilling of wells at various depths so as to prevent back-up of sand and other debris and which includes employing a sealing member above the last-to-be added casement in a position to close off the annular passage between the drill rod and the casement or drillpipe.

A further object of the invention is to provide a drilling apparatus for drilling a series of test wells which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE DRAWING

Figure 1:
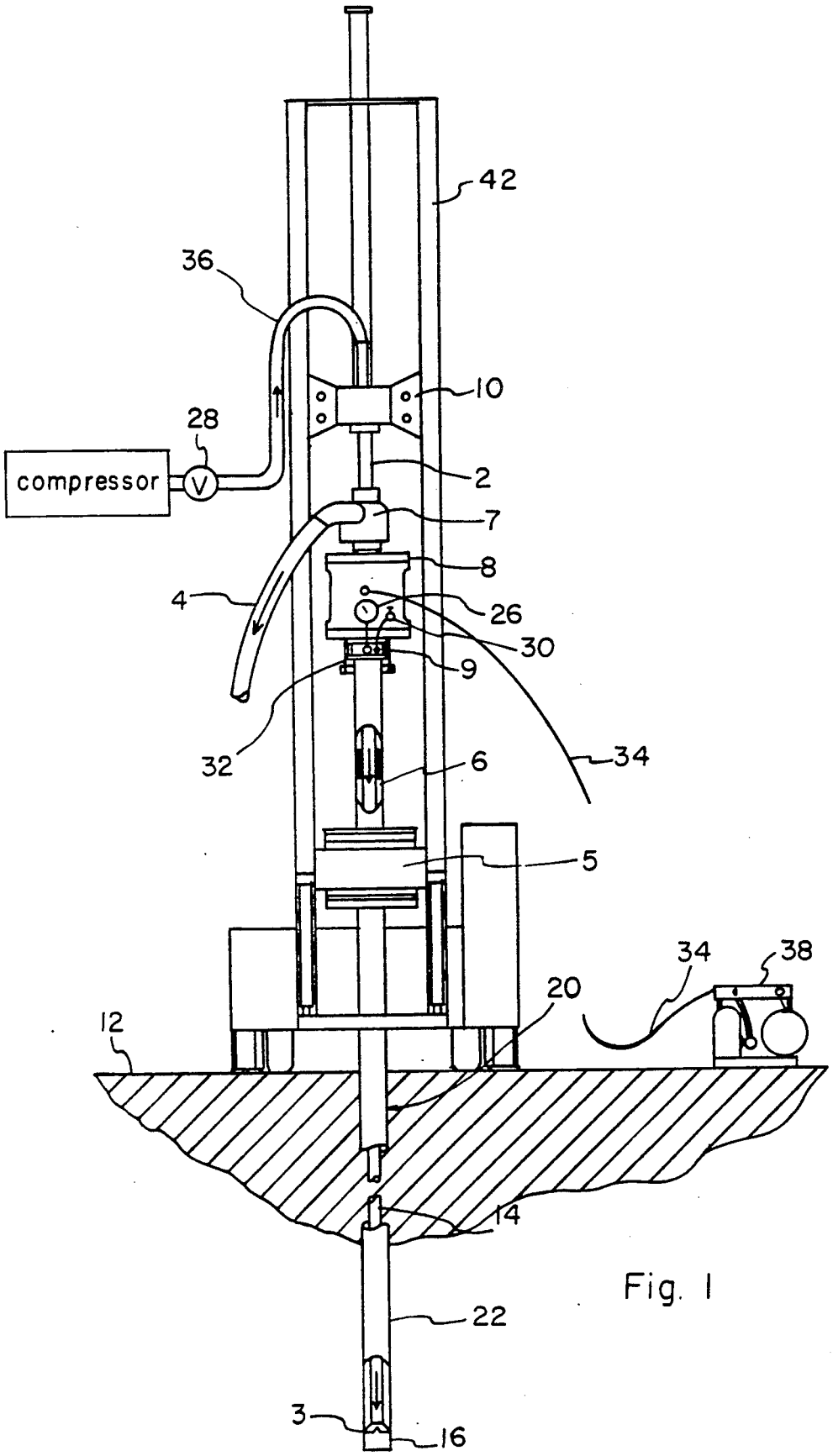
FIG. 1 is a front partially sectionally view of the drilling device used for drilling a series of test wells at various depths and constructed in accordance with the invention.

Referring to the drawings in particular, the invention embodied therein comprises a drill drive 10, such as a top head rotary drive, positioned above ground 12 with a discharge snorkel high pressure air arrangement associated with a drill rod 14 which has a lower drilling end 16 which extends downwardly into the well 20. The drill rod 14 is rotated by the drive 10 to cause the drill to penetrate the material as the material rises upwardly into a surrounding casing or drill pipe 22, under the action of high pressure air issuing from the drilling end 16 as the drilling takes place.

Whenever it is desirable to stop the drilling, for example to add a further length of drill pipe 22 and drill rod 14, the drive 10 is disconnected and a new drill pipe 22 and a new drill rod 14 member extension is added. In accordance with the invention, in order to prevent the material from entering into the casement space 6, pressure control means 26 is employed which includes a cylindrical sealing member 8 which may extend against the drilling member and seal the space around it preventing any lowering of pressure from the well location of the drilling end 16. The pressure may then be lowered by the pressure control means to prevent heaving of the material.

Figure 2:
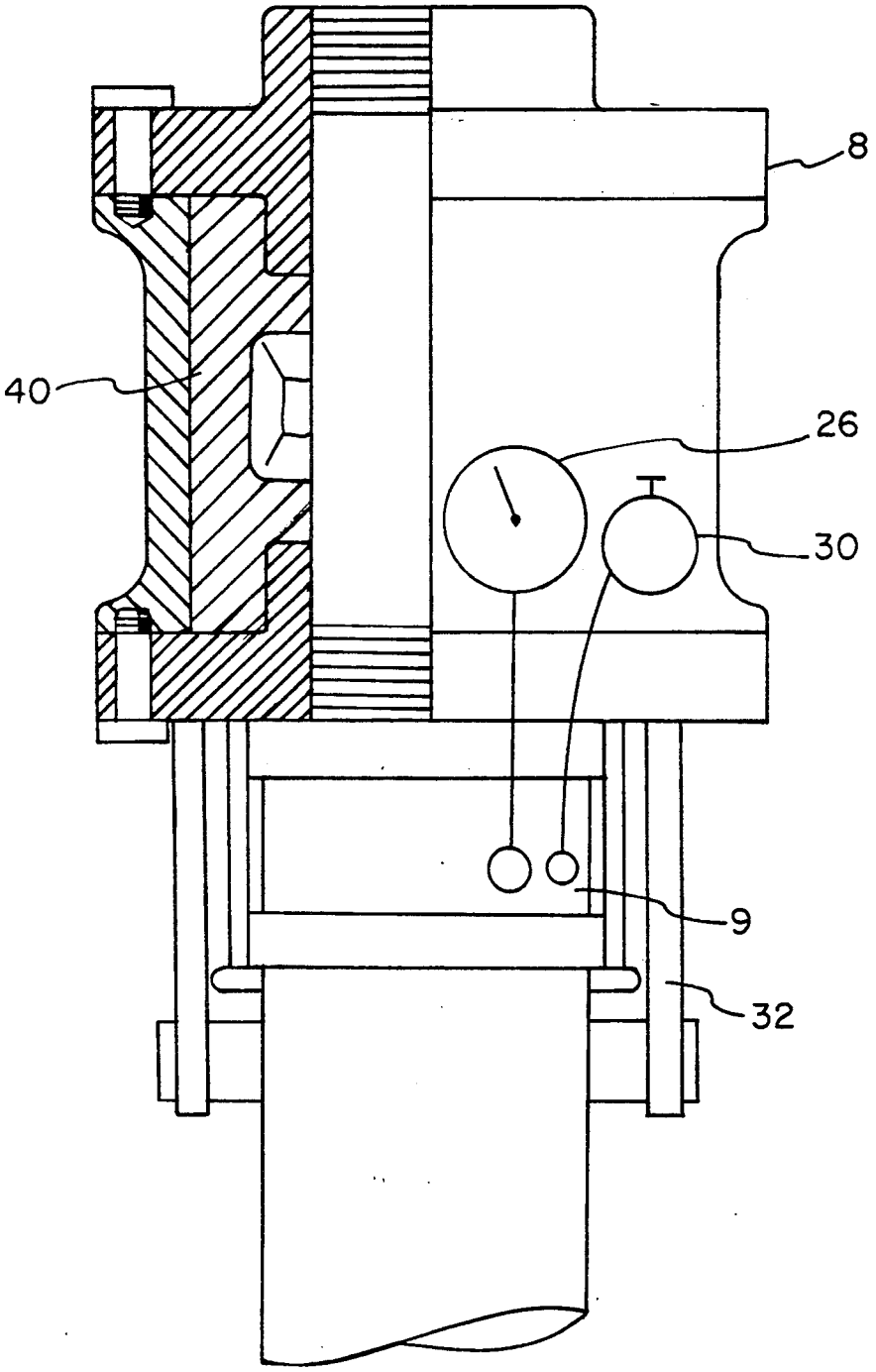
FIG. 2 is a front partially sectional view of a blowout preventor in accordance with the invention.

A blow-out preventor arrangement 8 is installed beneath the discharge snorkel 7, and attached to the drill pipe 22, using a specially designed dresser type connection 9 (see FIG. 2). The connection 9 has two ports for pressure measurement and air control devices 30. Metal hold down straps 32 are used to further strengthen the connection between the blow-out preventor 8 and the drill pipe 22.

For a prototype of the preferred embodiment, a 10¾" Regan Type K blow-out preventer was modified as discussed below.

The blow-out preventor 8 has been modified to permit the utilization of several connectors 9 that are compatible with different sized drill pipe 22. The top of the blow-out preventor 8 is modified to provide a compatible connection to the discharge snorkel 7. The blow-out preventor 8 is activated using an external engine driven hydraulic pump and blowout controls 30. To minimize contamination potential, vegetable oil is preferably utilized as the hydraulic fluid. The blow-out preventor activation circuit 34 is completed using hydraulic hose equipped with sealing quick disconnects (not shown).

According to a preferred method of the invention, when the previous section of the drill pipe 22, and the drill rod 14 are in their lowermost position, they are held in place by the lower rotary table 5 which is also in its lowest position.

The discharge snorkel 7 and the blow-out preventor 8 are chained to the top head rotary drill drive 10 in a position that allows the drill rod saver sub 2 to protrude from the bottom of the dresser connection 9. The top head rotary drill drive 10 is then raised and tilted rearwardly so that the whole assembly is approximately 60° from vertical. This operation is done to permit attachment of the next lengths of drill rod 14 and pipe 22. The next length of drill rod 14 and pipe 22 are pulled in behind the rig, and the connection of the 20 foot drill rod 14 is made to the saver sub 2 via a threaded connection (not shown). The length of drill pipe 22 is then slid up over the rod 14 to make its connection at the dresser coupling 9. Once the pipe is secured, the top head rotary drill drive 10 is raised to the top of the derrick 42, and the whole assembly is brought back into the vertical position. The lower joint of the drill rod section 14 is then made up to the drill rod 14 already in the ground. The section of the drill pipe is then welded to the end of the previously installed drill pipe 22 to form a continuous string. The jaws of the lower rotary table 5 are then unchucked and the table is raised up to a higher position on the pipe. The casing jaws of the lower table 5 are then rechucked to make firm contact with the drill pipe 22, thereby physically coupling the drilling machine to the drill pipe 22. The set-up operation is now complete, and drilling can begin.

A valve arrangement 28 controls both on-board and external air. These valves are opened to allow compressed air to flow into the rig air supply piping 36 via a screw compressor 44, through the top head rotary drill drive 10 and into the interior of the drill rod 14 as before. Once the hydrostatic pressure in the well is overcome, air escapes from the drill bit 3 and returns to the surface through the annular space 6. Any water or sediment present in the annular space 6 is also blown to the surface by the air. At this point the blow-out preventor 8 is in its relaxed open position thereby allowing free passage of the air. As before, the air and material enter the snorkel 7 where they are routed through the discharge hose 4. The air pressures in the system typically range from 60 to 100 psi, however, higher pressures are needed initially to overcome the hydrostatic pressure caused by the water column. Both the blow-out and the operating pressures increase, with increasing depth beneath the water table.

As air circulation is established, excavation of the formation sediments occurs at the bottom of the drill pipe 22 and drill bit 3. The prime force responsible for the excavation is the pressure differential at the bit caused by the buoyant force of the rising air. Concurrently with the establishment of circulation, the top head drill drive 10 is activated to cause a rotation of the drill rod 14 and drill bit 3. This is done to facilitate the cutting action of the bit.

As the ejection of sediments is witnessed or sensed at the surface, the lower table 5 is also activated causing rotation of the drill pipe 22 and the blow-out preventor 8. A bearing device in the bottom of the discharge snorkel 7 permits the snorkel to remain stationary, while the lower equipment and pipe rotates. The actions of the top head drive and lower table ar completely independent with respect to rotation speed and direction as well as their vertical position. The rotation causes a reduction of the skin friction on the drill pipe 22. Depending upon formation conditions, the pipe may be rotated constantly in one direction, or rocked back and forth in 180° swings.

As the excavation continues, the two drives 10 and 5 are lowered hydraulically causing the drill rod 14 and pipe 22 to go deeper in tandem. On occasion, the top head drill drive 10 is raised, causing the drill bit 3 to be pulled up inside the pipe to decrease the excavation, and blow out any accumulated material. This process continues until the pipe 22 and rod 14 reach the depth when it becomes necessary to add the next length of both. The typical drilling time for a 20-foot length is 10 to 15 minutes.

Once the depth is reached, the rotation of the lower table 5 which is now positioned immediately beneath the dresser connection 9, and at the bottom of the mat stroke, is stopped in a position which enables the operator to view and operate the air pressure controls 26, 30, 34 from the operator's station. The hose for the blow-out preventer energizing circuit 34 is then attached to the blow-out preventer using a quick disconnect hydraulic coupling (not shown).

Meanwhile, the top rotary drill drive 10 continues to rotate, with the air circulation maintained. Its vertical position is such that the bit 3 is situated at the bottom of the drill pipe 22, and the rod joint is in the correct position for disconnection.

Prior to the immediate activation of the blow-out preventor 8 the rotation of the top drill drive 10 and the drill rod 14 is stopped. The blow-out preventer is then energized by pumping a fluid under pressure into the cavity of the blow-out preventor 8 (see FIG. 2) by means of an engine driven hydraulic arrangement 38. The introduction of a pressurized fluid causes the rubber element 40 of the blow-out preventor to swell and encroach upon annular space 6. As the activation is occurring, an automatic control or the operator monitors the air pressure in the borehole to insure that the pressure in the annular space does not exceed the calculated hydrostatic pressure (equal to hold-out pressure) for that particular depth. The air volume entering the wall system through 36 is regulated by the operator to maintain correct pressure.

As the blow-out preventer rubber element 40 finally closes upon the drill rod 14 making a positive pressure seal, the air supply 36 is terminated. The valve associated with pressure control 26 is immediately closed to prevent the back flow of high pressure air. The well bore and all air piping downstream of the closed air supply valves is now under a static pressure equalling the calculated hold out pressure. After a preset period of time, air is then bled from the shut-in annular space 6 using an air flow control valve 30 at a rate of 2 psi/min. This controlled rate allows a water column in the annular space 6, to rise at a rate of 4.5 ft/min. (less than 0.10 ft/sec.). This velocity is slow enough to keep sediments with a mean grain size diameter of greater than 0.25 mm from rising with the water column. The bleeding operation continues until the pressure in the annular space is reduced to 0 gauge pressure (atmospheric). The blow-out preventor 8 is then de-energized by releasing the pressured fluid, back into the storage tank on the power pack 38 through the circuit 34. The drill pipe 22 is then uncoupled from the blow-out preventor 8 by releasing the dresser connection 9. The blow-out preventor 8 and the snorkel 7 are then chained in position on the top drill drive 10 and the joint between the drill rod saver sub 2 and the drill rod 14 is broken. The entire procedure then begins again.

The blow-out preventer 8 is normally energized using a standard hydraulic fluid. As a primary purpose of the invention is for use in operations relating to the installation of environmental monitoring wells, fluid that will minimize the risk of contamination as a result of failure is preferably used. Examples of such fluids are soybean and other vegetable oils, mineral oil and the like.

While specific embodiments of the invention have been shown and described in detail to illustrate the application of the principles of the invention, it will be understood that the invention may be embodied otherwise without departing from such principles.

What is claimed is:

1. A method for air rotary drilling in saturated unconsolidated deposits, comprising the steps of:

employing a drill rod connected to a drill drive in cooperation with a drill casing to form a well in said unconsolidated deposits; simultaneously providing air at high pressure to a bore formed in the drill rod to move material from a drill bit end at a drilling location up through a space defined between the drill rod and drill casing and progressively lowering the drill rod and drill casing; and, upon termination of high pressure to said drill location, maintaining a pressure level in said well and subsequently bleeding air from said well to successively reduce the pressure of said well to ambient pressure.

2. A method for air rotary drilling in saturated unconsolidated deposits, comprising the steps of:

employing a drill rod connected to a drill drive in cooperation with a drill casing to form a well in said unconsolidated deposits; simultaneously providing air at high pressure to a bore formed in the drill rod to move material from a drill bit end at a drilling location up through a space defined between the drill rod and drill casing; lowering the drill rod and drill casing as the well is formed and material is moved up through he space defined between the drill rod and drill casing; interrupting drilling for adding additional drill casing and drill rod upon said drill casing and drill rod being lowered a predetermined depth; and, terminating said high pressure air to said drill location and maintaining a pressure level in said well by restricting said space defined between the drill rod and drill casing in said well and subsequently bleeding air from said well to successively reduce the pressure of said well to ambient pressure.

* * * * *